US008723754B2

(12) United States Patent
Wang et al.

(10) Patent No.: US 8,723,754 B2
(45) **Date of Patent: *May 13, 2014**

(54) MULTI-BAND ANTENNA

(75) Inventors: Ying-Chih Wang, Tao Yuan Shien (TW); Tsung-Ming Kuo, Tainan (TW); Ling-Chen Wei, Tainan (TW)

(73) Assignee: Quanta Computer Inc., Tao Yuan Hsien (TW)

( * ) Notice: Subject to any disclaimer, the term of this patent is extended or adjusted under 35 U.S.C. 154(b) by 539 days.

This patent is subject to a terminal disclaimer.

(21) Appl. No.: 13/066,504

(22) Filed: Apr. 14, 2011

(65) Prior Publication Data

US 2012/0139802 A1 Jun. 7, 2012

(30) Foreign Application Priority Data

Dec. 1, 2010 (TW) ..... 99141699 A

(51) Int. Cl.
*H01Q 1/00* (2006.01)

(52) U.S. Cl.
USPC ..... 343/905; 343/728; 343/702

(58) Field of Classification Search
USPC ..... 343/905, 728, 702
See application file for complete search history.

(56) References Cited

U.S. PATENT DOCUMENTS

2009/0160714 A1* 6/2009 Qi et al. ..... 343/702

* cited by examiner

*Primary Examiner* — Kristy A Haupt
(74) *Attorney, Agent, or Firm* — Kramer Levin Naftalis & Frankel LLP

(57) ABSTRACT

A multi-band antenna includes a loop conductor, a first conductor arm, and a second conductor arm. The loop conductor is configured to resonate in a first frequency band and includes a feed-in end for feeding of signals and a main body that extends from the feed-in end, and that has a grounding point disposed adjacent to the feed-in end. The first conductor arm is configured to resonate in a second frequency band and extends from the feed-in end. The second conductor arm is configured to resonate in a third frequency band and extends from the feed-in end. At least one of the loop conductor, the first conductor arm, and the second conductor arm is bent so as to be disposed in different planes.

10 Claims, 11 Drawing Sheets

MULTI-BAND ANTENNA

CROSS-REFERENCE TO RELATED APPLICATION

This application claims priority of Taiwanese Application No. 099141699, filed on Dec. 1, 2010.

BACKGROUND OF THE INVENTION

1. Field of the Invention

The present invention relates to an antenna, more particularly to a multi-band antenna for application to Wireless Local Area Network (WLAN) and World Interoperability for Microwave Access (WiMAX) communication protocols.

2. Description of the Related Art

Conventional antennas are usually not designed to be simultaneously compatible with Wireless Local Area Network (WLAN) and World Interoperability for Microwave Access (WiMAX) communication protocols. Accordingly, multiple antennas are required to be disposed in an electronic device in order to ensure compatibility of the electronic device with WLAN and WiMAX communication protocols. As a consequence, more space is required in the electronic device, thereby affecting adversely the size of the electronic device.

Some Planar Inverted-F Antennas (PIFA) are designed to employ parasitic elements for enhancing antenna coupling that is dependent upon clearances formed among radiator components and a grounding conductor so as to achieve effects of broadband operation. However, it is difficult to control impedance frequency and bandwidth of the antenna. Moreover, efficiency of the antenna is relatively low.

SUMMARY OF THE INVENTION

Therefore, the object of the present invention is to provide a multi-band antenna that is simultaneously compatible with WLAN and WiMAX communication protocols Accordingly, a multi-band antenna of this invention comprises a loop conductor, a first conductor arm, and a second conductor arm.

The loop conductor is configured to resonate in a first frequency band and includes a feed-in end for feeding of signals and a main body that extends from the feed-in end, and that has a grounding point disposed adjacent to the feed-in end. The first conductor arm is configured to resonate in a second frequency band and extends from the feed-in end. The second conductor arm is configured to resonate in a third frequency band and extends from the feed-in end. At least one of the loop conductor, the first conductor arm, and the second conductor arm is bent so as to be disposed in different planes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
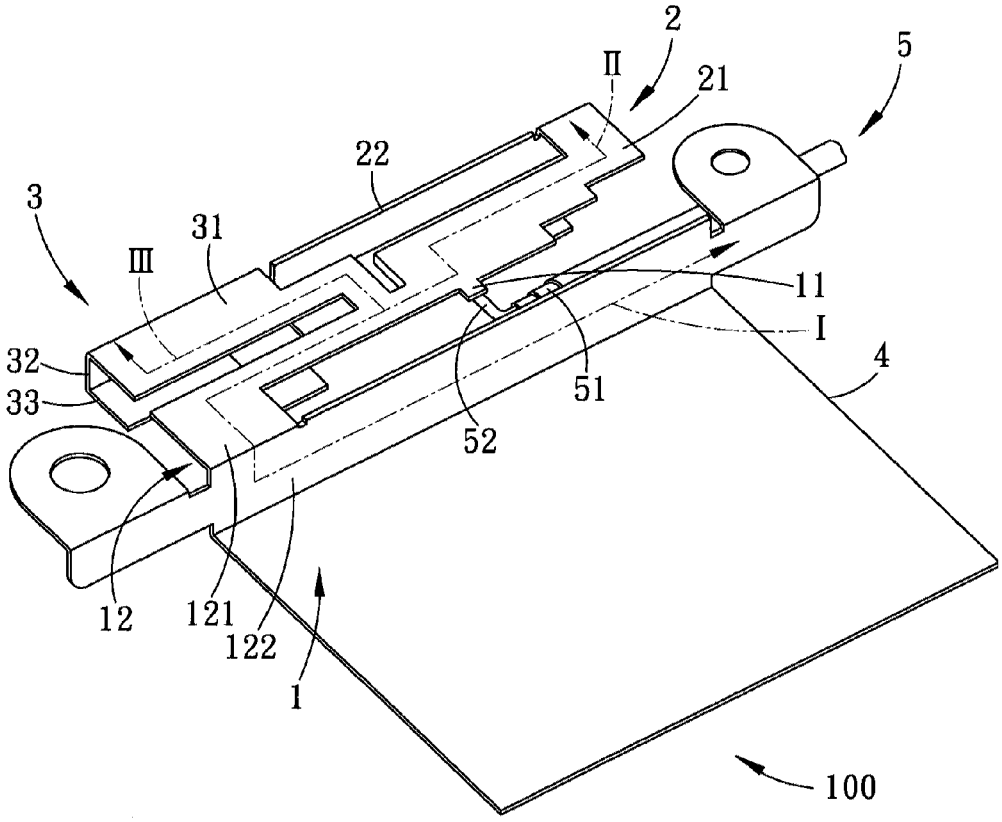
FIG. 1 is a perspective view of a preferred embodiment of a multi-band antenna according to the present invention.
Figure 2:
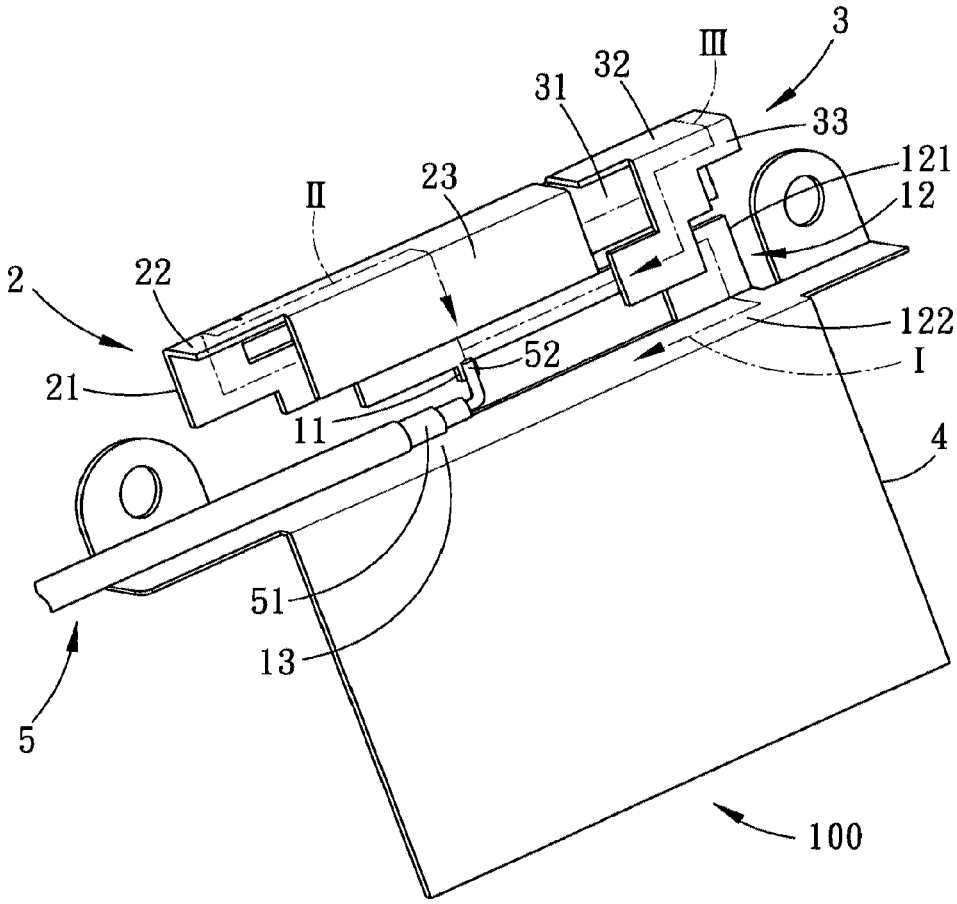
FIG. 2 is another perspective view of the preferred embodiment.
Figure 3:
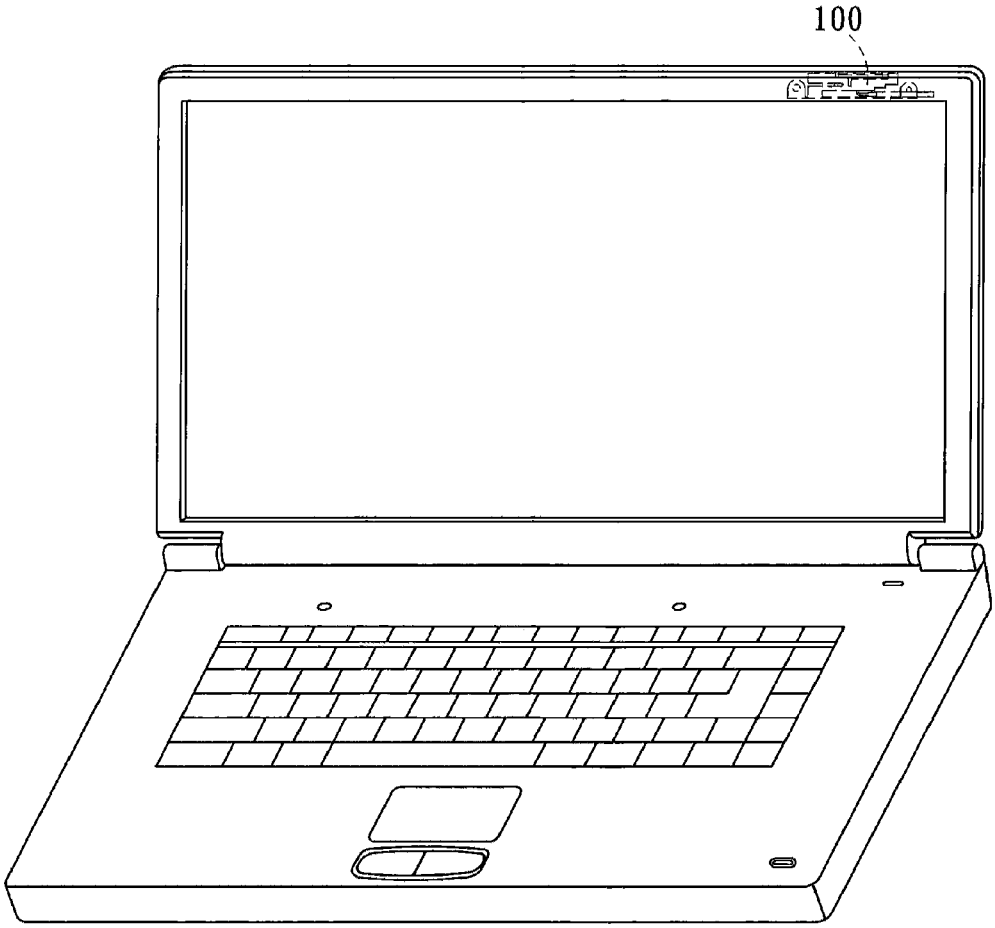
FIG. 3 is a perspective view of a notebook computer provided with the preferred embodiment.

Referring to FIGS. 1 and 2, a preferred embodiment of the multi-band antenna 100 of the present invention includes a loop conductor 1, a first conductor arm 2, a second conductor arm 3, a conductive copper foil 4, and a coaxial cable 5. In this embodiment, the multi-band antenna 100 is for disposing in a panel device of a notebook computer (see FIG. 3).

The loop conductor 1 is configured to resonate in a first frequency band, and includes a feed-in end 11 for feeding of signals and a generally U-shaped main body 12 that extends from the feed-in end 11 and that has a grounding point 13.

The main body 12 includes a generally L-shaped first radiator section 121 connected to the feed-in end 11, and a second radiator section 122 connected to one end of the first radiator section 121 opposite to the feed-in end 11 and extending along a straight line. The grounding point 13 is disposed on the second radiator section 122 adjacent to the feed-in end 11.

In this embodiment, the loop conductor 1 is bent such that the first radiator section 121 and the second radiator section 122 are disposed respectively on first and second planes that are substantially perpendicular to each other. Current in the loop conductor 1 flows from the feed-in end 11 to the second radiator section 122 through the first radiator section 121 as indicated by arrow (I) in FIGS. 1 and 2.

The first conductor arm 2 is configured to resonate in a second frequency band and extends from the feed-in end 11. The first conductor arm 2 includes a first portion 21 connected to the feed-in end 11, a second portion 22 connected to one end of the first portion 21 opposite to the feed-in end 11, and a third portion 23 connected to the second portion 22.

In this embodiment, the first conductor arm 2 is bent such that the first, second, and third portions 21,22, 23 are disposed on different planes, in which the first portion 21 is disposed on the first plane, the second portion 22 is disposed on a third plane that is substantially perpendicular to the first plane and that is spaced apart from the second plane, and the third portion 23 is disposed on a fourth plane that is substantially perpendicular to each of the second and third planes and that is spaced apart from the first plane. It is noted that the feed-in end 11 is disposed on the first plane. The third portion 23 is parallel to and spaced apart from the first radiator section 121 and extends toward the second radiator section 122. Current in the first conductor arm 2 flows from the feed-in end 11 and passes through the first and second portions 21, 22 to the third portion 23 as indicated by arrow (II) in FIGS. 1 and 2.

The second conductor arm 3 is configured to resonate in a third frequency band and extends from the feed-in end 11. The second conductor arm 3 includes a fourth portion 31 connected to the feed-in end 11, a fifth portion 32 connected to one end of the fourth portion 31 opposite to the feed-in end 11, and a sixth portion 33 connected to the fifth portion 32. In this embodiment, the second conductor arm 3 is bent such that the fourth, fifth, and sixth portions 31, 32, 33 are disposed on different planes, in which the fourth portion 31 is disposed on the first plane, the fifth portion 32 is disposed on the third plane, and the sixth portion 33 is disposed on the fourth plane. The sixth portion 33 extends toward the second radiator section 122. Current in the second conductor arm 3 flows from the feed-in end 11 and passes through the fourth and fifth portions 31, 32 to the sixth portion 33 as indicated by arrow (III) in FIGS. 1 and 2.

By bending the loop conductor 1, the first conductor arm 2, and the second conductor arm 3 so as to be disposed on the abovementioned first, second, third, and fourth planes, area occupied by the multi-band antenna 100 can be reduced.

In order to increase grounding area of the multi-band antenna 100, the conductive copper foil 4 is connected to the second radiator section 122. The coaxial cable 5 is disposed adjacent to the second radiator section 122 and has an outer conductor 51 that is electrically connected to grounding point 13 and an inner conductor 52 that is electrically connected to the feed-in end 11.

Figure 4:
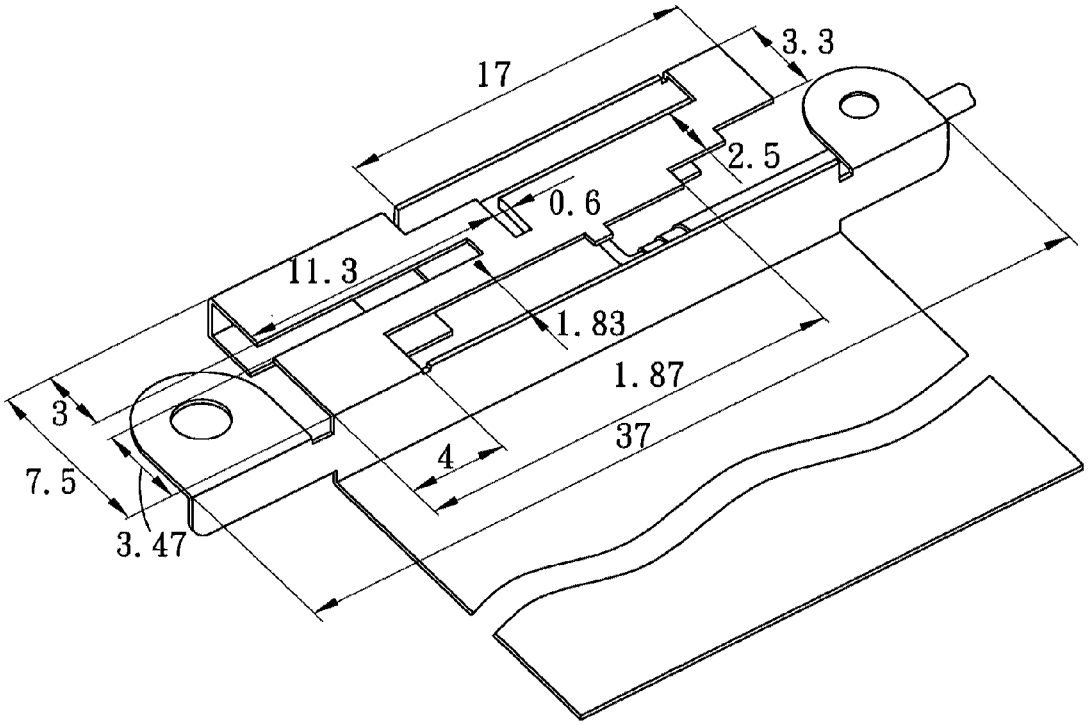
FIG. 4 is a schematic diagram illustrating dimensions of the preferred embodiment.
Figure 5:
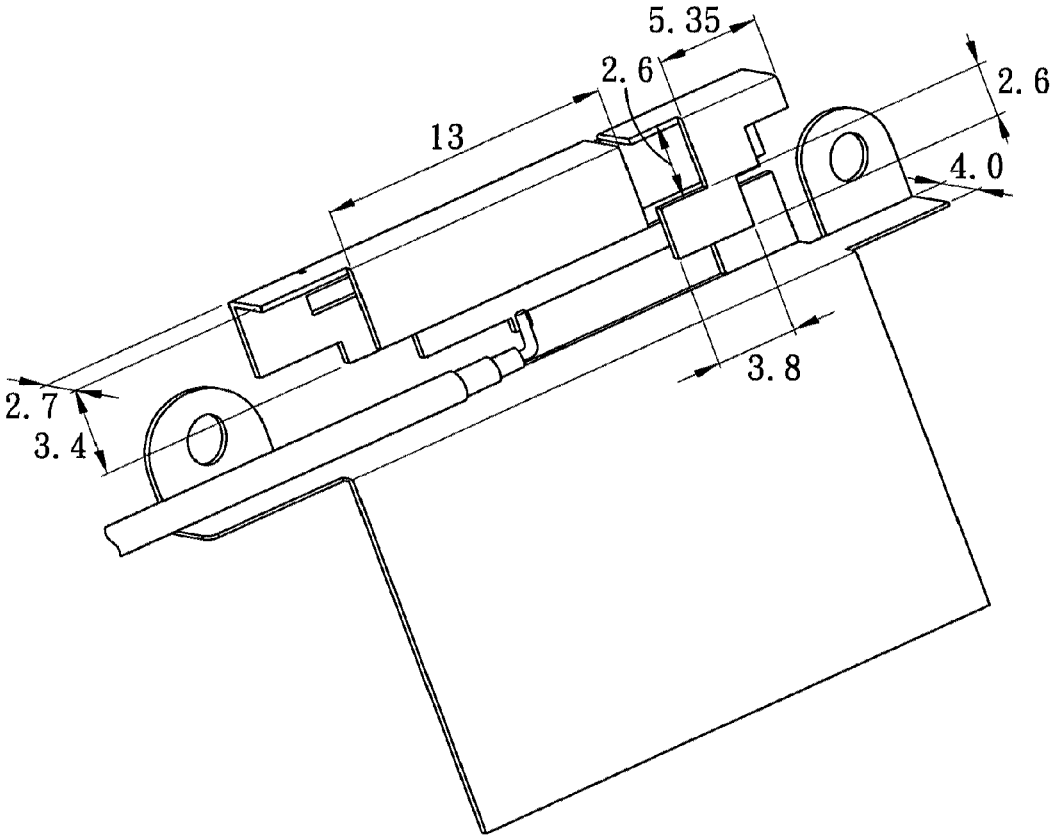
FIG. 5 is another schematic diagram illustrating dimensions of the preferred embodiment.

Referring to FIGS. 4 and 5, the detailed dimensions (in mm) of the multi-band antenna 100 of the preferred embodiment are shown. Preferably, the loop conductor 1 is in a form of half wavelength of a Planar Inverted-F Antenna (PIFA). The first and second conductor arms 2, 3 have lengths substantially equal to one quarter of wavelengths of the second and third frequency bands, respectively. With the dimensions shown in FIGS. 4 and 5, the first frequency band ranges from 5.15 GHz~5.85 GHz, the second frequency band ranges from 2.3 GHz~2.7 GHz, and the third frequency band ranges from 3.3 GHz~3.8 GHz, which are compatible with WLAN and WiMAX communication protocols.

Figure 6:
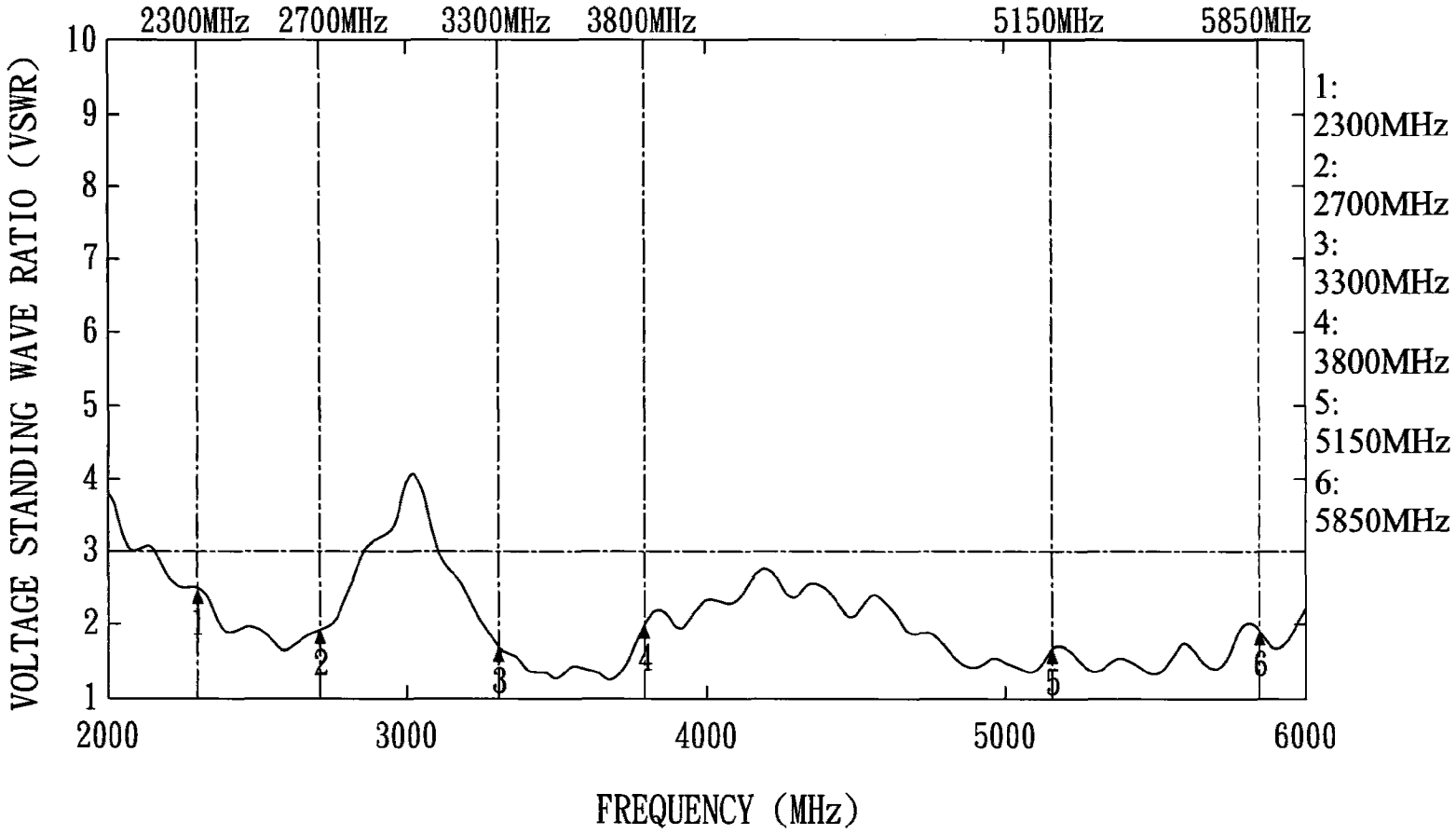
FIG. 6 is a Voltage Standing Wave Ratio (VSWR) plot showing VSWR values of the preferred embodiment.
Figure 7:
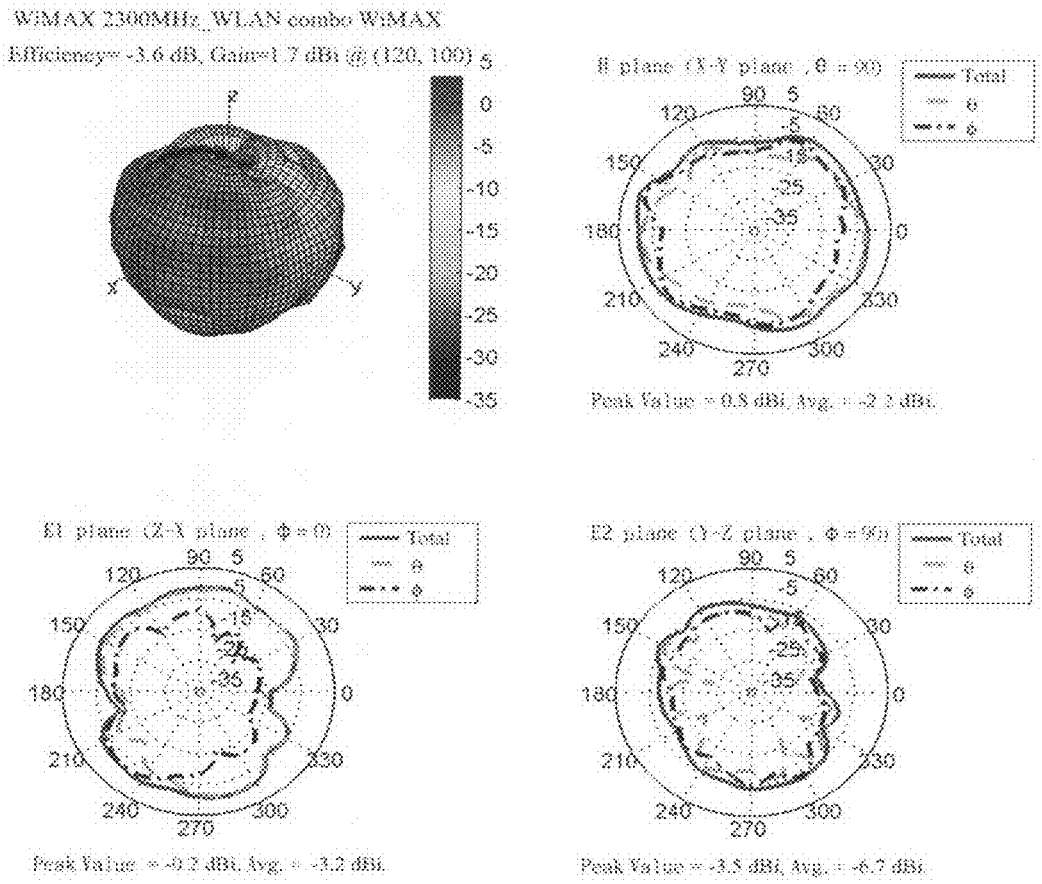
FIG. 7 illustrates radiation patterns of the preferred embodiment operating at 2300 MHz.
Figure 8:
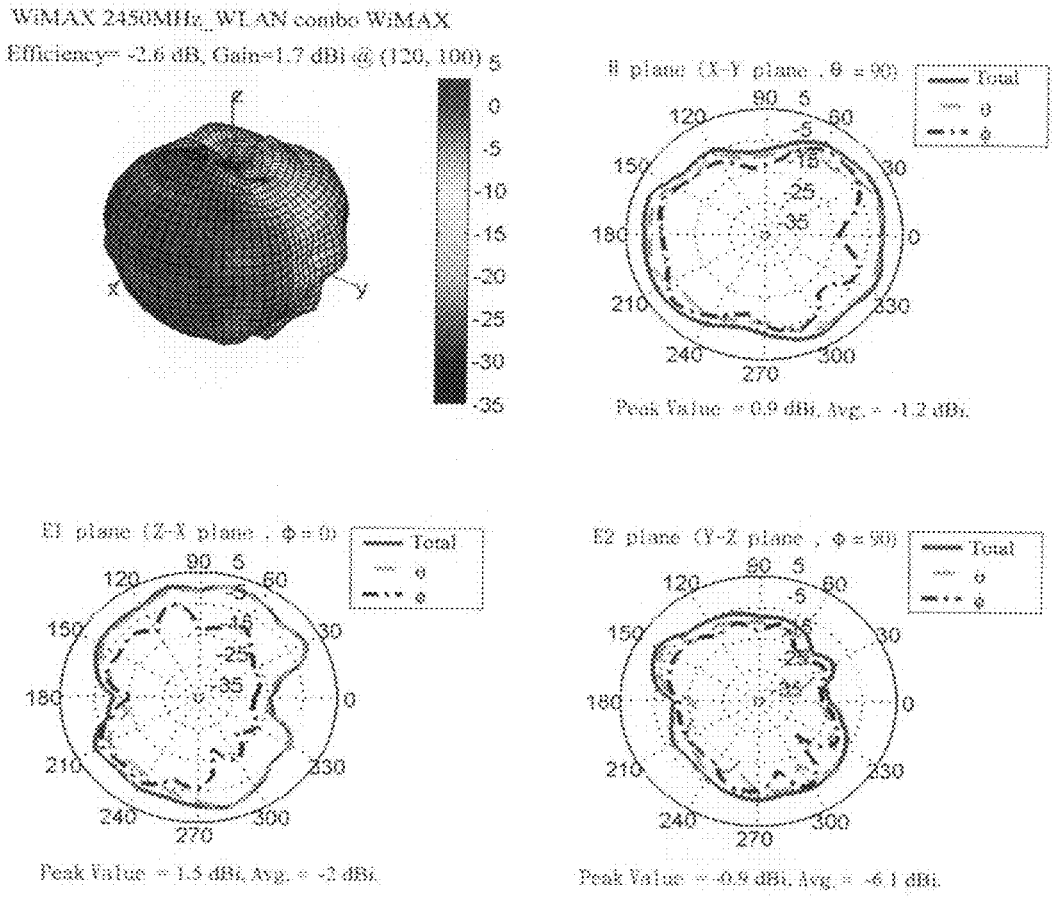
FIG. 8 illustrates radiation patterns of the preferred embodiment operating at 2450 MHz.
Figure 9:
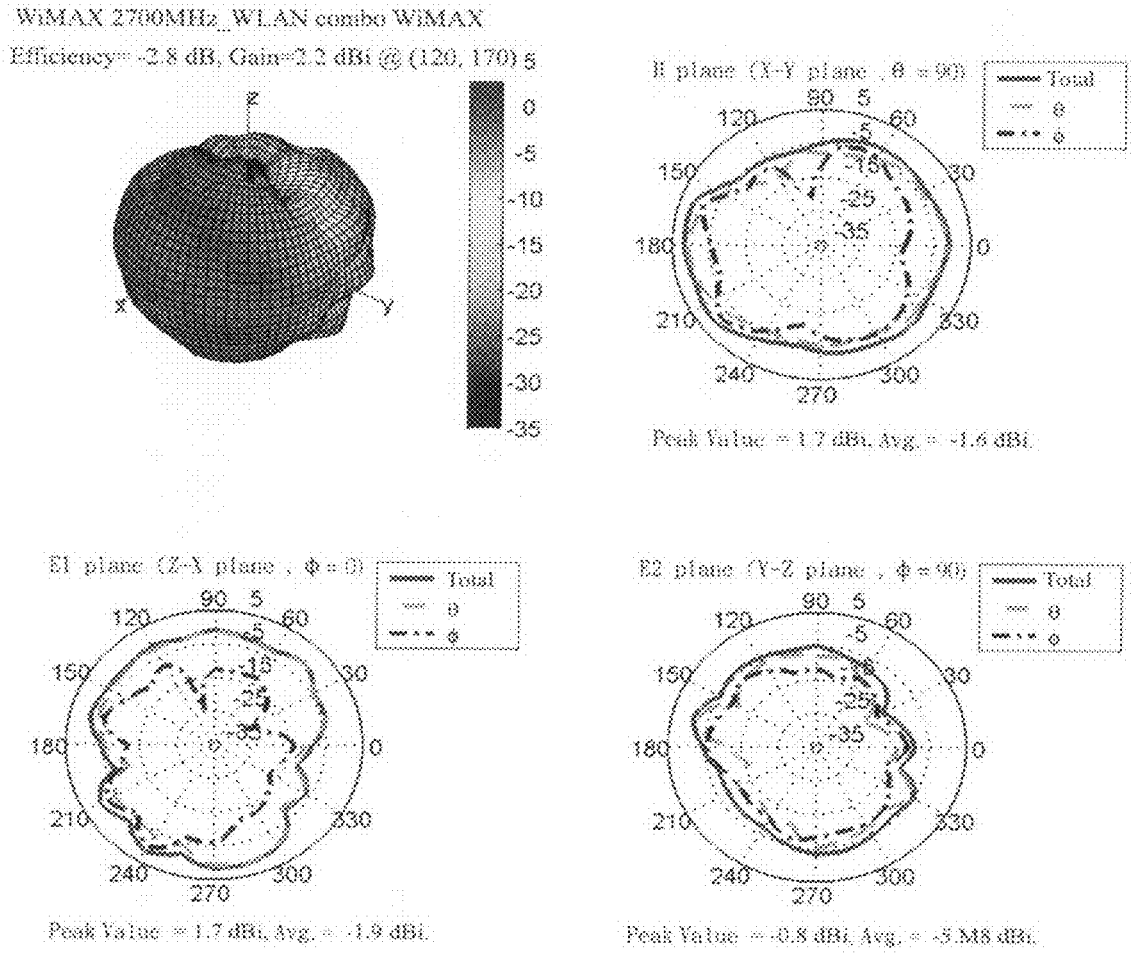
FIG. 9 illustrates radiation patterns of the preferred embodiment operating at 2700 MHz.
Figure 10:
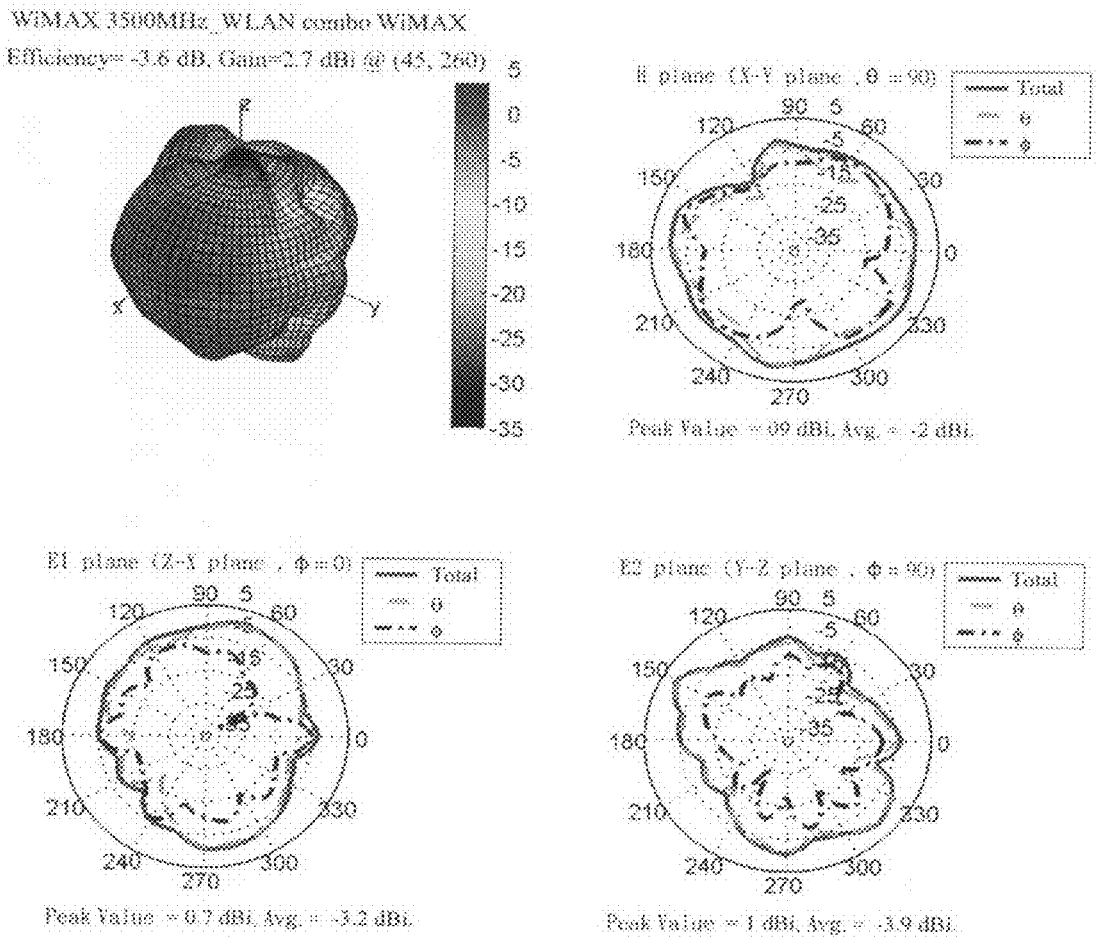
FIG. 10 illustrates radiation patterns of the preferred embodiment operating at 3500 MHz.
Figure 11:
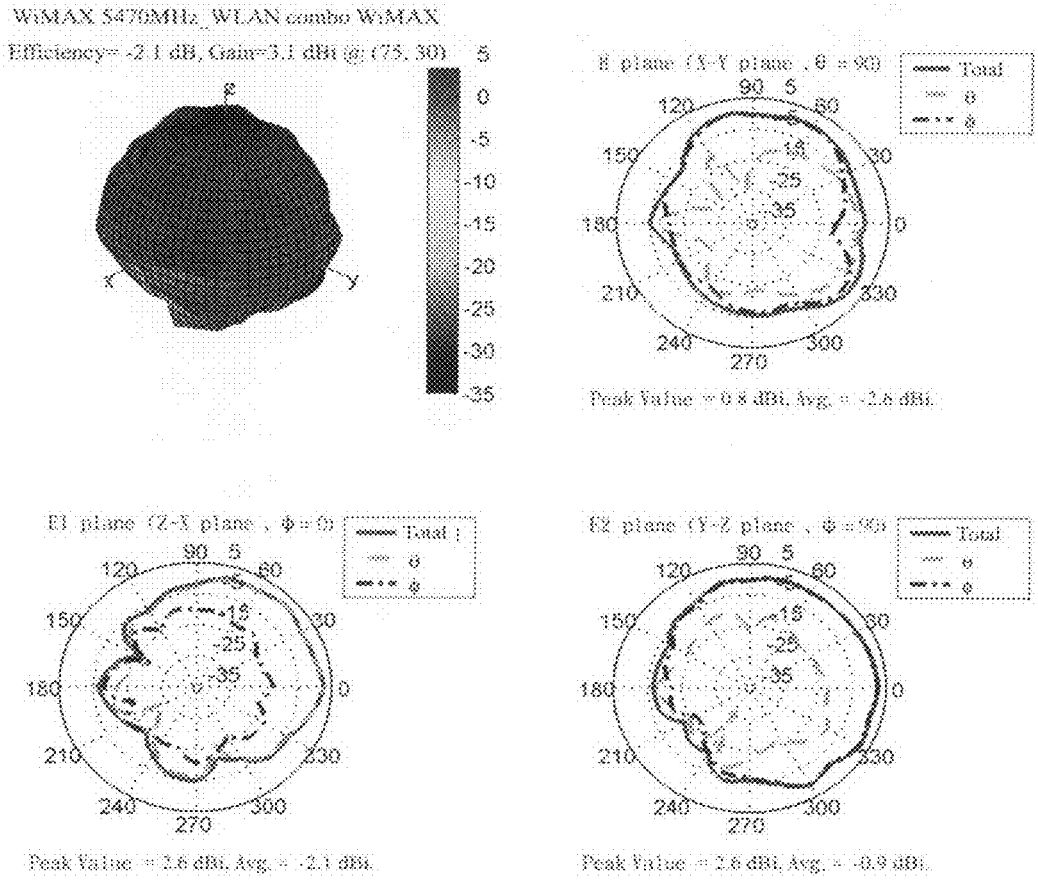
FIG. 11 illustrates radiation patterns of the preferred embodiment operating at 5470 MHz.

Referring to FIG. 6, which is a voltage standing wave ratio (VSWR) plot of this embodiment, the VSWR values of the multi-band antenna 100 of this embodiment at the first, second, and third frequency bands are smaller than 3:1. According to Table 1 below, the radiation efficiency of the multi-band antenna 100 is greater than 30% at frequencies within the first, second, and third frequency bands.

TABLE 1

| Frequency (MHz) | Efficiency (dB) | Efficiency (%) |
|---|---|---|
| 2300 | −3.5 | 44.0 |
| 2350 | −4.1 | 38.5 |
| 2400 | −3.6 | 43.0 |
| 2450 | −2.6 | 54.8 |
| 2500 | −2.9 | 51.0 |
| 2550 | −3.2 | 46.9 |
| 2600 | −3.0 | 49.2 |
| 2650 | −3.0 | 49.6 |
| 2700 | −2.8 | 52.1 |
| 3300 | −4.1 | 38.7 |
| 3400 | −3.6 | 43.0 |
| 3500 | −3.5 | 44.0 |
| 3600 | −4.2 | 37.7 |
| 3700 | −3.8 | 40.9 |
| 3800 | −4.1 | 38.5 |
| 5150 | −1.6 | 68.3 |
| 5250 | −1.8 | 65.1 |
| 5350 | −1.8 | 65.5 |
| 5470 | −2.1 | 61.1 |
| 5600 | −1.9 | 63.1 |
| 5725 | −2.2 | 59.8 |
| 5785 | −2.7 | 53.3 |
| 5850 | −3.4 | 44.9 |

FIGS. 7 to 11 illustrate radiation patterns of the multi-band antenna 100 of this embodiment. It is evident from these figures that the radiation patterns of the multi-band antenna 100 in the first, second, and third frequency bands have relatively good omni-directionality.

To sum up, the loop conductor 1, the first conductor arm 2, and the third conductor arm 3 resonate respectively in the first frequency band (5.15 GHz~5.85 GHz), the second frequency band (2.3 GHz~2.7 GHz), and the third frequency band (3.3 GHz~3.8 GHz). Therefore, the multi-band antenna 100 of this invention is simultaneously compatible with WLAN and WiMAX communication protocols, occupies a relatively small area, and is suitable for application to thin electronic devices.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna comprising:

a loop conductor configured to resonate in a first frequency band and including a feed-in end for feeding of signals and a main body that extends from said feed-in end, and that has a grounding point disposed adjacent to said feed-in end;

a first conductor arm configured to resonate in a second frequency band and extending from said feed-in end; and a second conductor arm configured to resonate in a third frequency band and extending from said feed-in end;

wherein at least one of said loop conductor, said first conductor arm, and said second conductor arm is bent so as to be disposed in different planes.

2. The multi-band antenna as claimed in claim 1, wherein said main body includes a first radiator section connected to said feed-in end, and a second radiator section connected to one end of said first radiator section opposite to said feed-in end, said grounding point being disposed on said second radiator section.

3. The multi-band antenna as claimed in claim 2, wherein said first conductor arm includes a first portion connected to said feed-in end, a second portion connected to one end of said first portion opposite to said feed-in end, and a third portion connected to said second portion, said first, second, and third portions being disposed on different planes.

4. The multi-band antenna as claimed in claim 3, wherein said second conductor arm includes a fourth portion connected to said feed-in end, a fifth portion connected to one end of said fourth portion opposite to said feed-in end, and a sixth portion connected to said fifth portion, said fourth, fifth, and sixth portions being disposed on different planes.

5. The multi-band antenna as claimed in claim 4, wherein said feed-in end, said first radiator section, said first portion and said fourth portion are disposed on a first plane.

6. The multi-band antenna as claimed in claim 5, wherein said second radiator section is disposed on a second plane that is substantially perpendicular to the first plane.

7. The multi-band antenna as claimed in claim 6, wherein said second portion and said fifth portion are disposed on a third plane that is substantially perpendicular to said first plane and that is spaced apart from said second plane.

8. The multi-band antenna as claimed in claim 7, wherein said third portion and said sixth portion are disposed on a fourth plane that is substantially perpendicular to each of said second and third planes and that is spaced apart from said first plane.

9. The multi-band antenna as claimed in claim 8, wherein said first frequency band ranges from 5.15 GHz~5.85 GHz, said second frequency band ranges from 2.3 GHz~2.7 GHz, and said third frequency band ranges from 3.3 GHz~3.8 GHz.

10. The multi-band antenna as claimed in claim 8, further comprising a conductive copper foil connected to said second radiator section.

* * * * *